US007160576B2

(12) United States Patent
Lerche et al.

(10) Patent No.: US 7,160,576 B2
(45) Date of Patent: Jan. 9, 2007

(54) METHOD AND DEVICE FOR BLACKING COMPONENTS

(75) Inventors: Wolfgang Lerche, Kleve (DE); Hansjakob Drissen, Bedburg-Hau (DE); Winfried Gräfen, Duisburg (DE); Walter Ooster, Bedburg/Hau (DE)

(73) Assignee: Ipsen International GmbH (DE)

( * ) Notice: Subject to any disclaimer, the term of this patent is extended or adjusted under 35 U.S.C. 154(b) by 446 days.

(21) Appl. No.: 10/632,037

(22) Filed: Jul. 30, 2003

(65) Prior Publication Data

US 2004/0022944 A1 Feb. 5, 2004

(30) Foreign Application Priority Data

Aug. 1, 2002 (DE) ..... 102 35 131

(51) Int. Cl.
*C23C 16/26* (2006.01)

(52) U.S. Cl. ..... 427/249.1; 427/249.6; 427/294

(58) Field of Classification Search ..... None
See application file for complete search history.

(56) References Cited

U.S. PATENT DOCUMENTS 3,892,890 A * 7/1975 Watanabe et al. ..... 427/249.1
4,060,660 A * 11/1977 Carlson et al. ..... 428/408
4,168,186 A 9/1979 Limque et al.
4,472,209 A 9/1984 Langerich et al.
4,522,880 A * 6/1985 Klostermeier et al. ..... 428/332
5,558,908 A * 9/1996 Lukacs III et al. ..... 427/228
5,753,317 A * 5/1998 Law et al. ..... 427/487

FOREIGN PATENT DOCUMENTS

| | | |
|---|---|---|
| DE | 2636273 | 2/1978 |
| DE | 4333940 | 12/1994 |
| EP | 0655512 | 5/1995 |
| EP | 0 818 555 | 1/1998 |
| EP | 0 882 811 | 12/1998 |
| EP | 1 193 413 | 4/2002 |

* cited by examiner

*Primary Examiner*—Bret Chen
(74) *Attorney, Agent, or Firm*—Cantor Colburn LLP

(57) ABSTRACT

The invention concerns a method for blacking components. In order to develop a method which creates black surfaces on components which are not inclined to peal off, and in which no fluids or baths are used which are expensive to produce, maintain or dispose of, it is proposed that the surfaces of the component are subjected to a heat treatment with simultaneous administration of a carbon-emitting medium inside the processing space. Furthermore, the invention concerns a device that can be operated using the method of the invention.

9 Claims, 1 Drawing Sheet

METHOD AND DEVICE FOR BLACKING COMPONENTS

FIELD OF THE INVENTION

The invention concerns a method for blacking components. Furthermore, the invention concerns a device with which the method of the invention can be implemented.

DESCRIPTION OF THE RELATED ART

Various methods for generating black surfaces are known from the state of the art. Here it is a matter of an oxidation method within gaseous atmospheres or liquid media as well as galvanic treatments. Black surfaces are generated in order, for example, to obtain an attractive surface of the component, to make the surface more corrosion resistant, for example, against film rust, and to obtain a higher resistance to abrasion.

A method for manufacturing uniform oxidation layers on metal workpieces in connection with a nitriding or nitrocarburizing method is known from EP 0 655 512 B1 in which the workpieces are exposed to an oxidation atmosphere for a specified time after nitriding or nitrocarburizing at a given temperature. During reoxidation, the outer edge layer of the workpiece, which basically consists of iron nitrides or carbon nitrides, is transformed in to a thin iron oxide layer. A layer of $Fe_3O_4$ is sought here. This layer has a black coloration. The disadvantage here is that the separate reprocessing represents an additional operation.

A method for treating parts, especially steel and/or cast parts, is known from DE 43 33 940 C1 in which a blacked surface is created in that the parts are simultaneously oxidized and hardened in a furnace using the introduction or injection of a reducing and oxidizing acting reaction gas at hardening temperatures. Here the disadvantage is that a stress on the furnace arises through the direct introduction in the hot state. Furthermore, a veil of flames must surround the part in order to prevent a premature oxidation during heating.

A further possibility for blacking surfaces consists in quenching the workpiece after tempering in an emulsion due to which the oxidized surface is blacked. Here the disadvantage is that an additional step must be performed. The emulsion must be protected against infestation with microbes, and it can only be disposed of by expensive treatment measures.

Reprocessing in liquids represents a further possibility for blacking the component surfaces. Here the components are dipped into so-called burnishing baths or salt baths after hardening. It is matter of additional steps in this process as well and the baths must be produced, monitored and eliminated at great expense. The problem is that they contain cyanides, in particular, in salt baths. Disposal is consequently costly and expensive.

A further possibility consists in galvanic solutions in electrolytic blacking. Here it is a question of black chromatin. But different colors can arise in this process on the basis of possible uneven layer thicknesses in metal precipitation. Furthermore, the disadvantage is that here an additional processing step is necessary and that the galvanic solution must be disposed of at great expense.

Generally the disadvantage in all oxide methods is that the oxide layers have an inclination to peel off if the oxide layer is too thick or there is not sufficient adhesion between oxide layer and surface. A greater layer of thickness can be necessary to obtain sufficient blacking.

SUMMARY OF THE INVENTION

Consequently the invention is based upon creating a process for blacking surfaces which creates black surfaces without an additional step with no tendency to peel off. No liquids or baths that are expensive to produce, maintain or dispose of are to be used. Furthermore, a device for implementing this method is to be created.

The realization of the objective in accordance with the invention provides that the surface is subjected to a heat treatment with simultaneous administration of a carbon-emitting medium within a treatment space. The surface of the component that is already situated within the treatment space is brought into contact with carbon. This occurs by the decomposition of the carbon-emitting medium. This takes place through the administration of heat. The carbon reacts with the surface of the component and blackens the latter.

Moreover, deep black surfaces are advantageously created while avoiding the previously cited disadvantages. With this method, in particular black surfaces can be created on tools that under certain circumstances have unattractive surfaces after hardening. Furthermore, the resistance to corrosion of the components can also be increased. Since the surfaces receive a "satin-like" luster, durable, decorative surfaces, for example for housings of stereo equipment or other metal parts which also have a design function in addition to functionality can be created.

An advantageous refinement of the invention provides that the heat treatment takes place at low temperatures. Moreover, a low pressure of 0.01 mbar to 100 mbar can be applied. Preferably the low pressure can move in a range from 0.1 mbar to 15 mbar. Low pressure makes possible a more favorable dosing of the carbon content in the furnace space, which prevents a sooting of the furnace space. At higher pressures, especially under atmospheric conditions, the dosable proportion of the carbon-emitting medium is too high, which unavoidably leads to a sooting of the furnace space in a disadvantageous manner. In this way, the costs for the carbon-emitting medium are also higher and the furnace must regularly be subjected to soot removal in order to guarantee optimal processing.

The heat treatment itself can be conducted at a temperature from 200° C. to 700° C. A good exchange of carbon with the surface of the component is reached in this temperature range. Preferably the temperature reaches 300° C. to 570° C., especially preferably from 350° C. to 475° C. Moreover, the duration of the heat treatment can regulated by a variation in temperature and/or pressure. The carbon content itself can be regulated inside the treatment space by a variation in pressure. The regulation can be necessary in order to reach a change of atmosphere in the treatment space through the duration of the treatment.

The carbon-emitting medium can be introduced into the treatment space in the form of a gas. Furthermore, a liquid feed is also possible. Hydrocarbons, especially acetylene, carbon monoxide or a mixture of them can be administered. These substances are suitable as a supplier of carbon owing to their good ability to decompose. But other substances are also conceivable as a carbon-emitting medium.

By reason of properties, no demands are to be placed upon the rate of cooling. For this reason, a cooling should be conducted as soon as possible at the end of the process due to plant availability.

The invention provides a device with a heatable processing space and a device for regulated administration of the carbon-emitting medium for implementing the process of the invention. The processing space can be evacuable. For evacuation of the processing space, a device, especially a vacuum pump, can be provided. Moreover, a monitoring device for the carbon content in the atmosphere can be provided in order to obtain a regulated administration of the carbon-emitting medium.

A furnace can be provided as a processing space. The furnace can have a liner. The liner can be made of metal. This must be dispensed with if catalytically acting surfaces are present. In such cases, the liner should not be metallic. Preferably, the liner can be constructed interchangeably in order to be able to eliminate any sooting.

BRIEF DESCRIPTION OF THE DRAWINGS

The invention will be explained in greater detail below in a non-limiting manner on the basis of a drawing consisting of only one FIGURE.

The sole FIGURE illustrates a device of the invention in diagrammatic representation.

DETAILED DESCRIPTION

Figure 1:
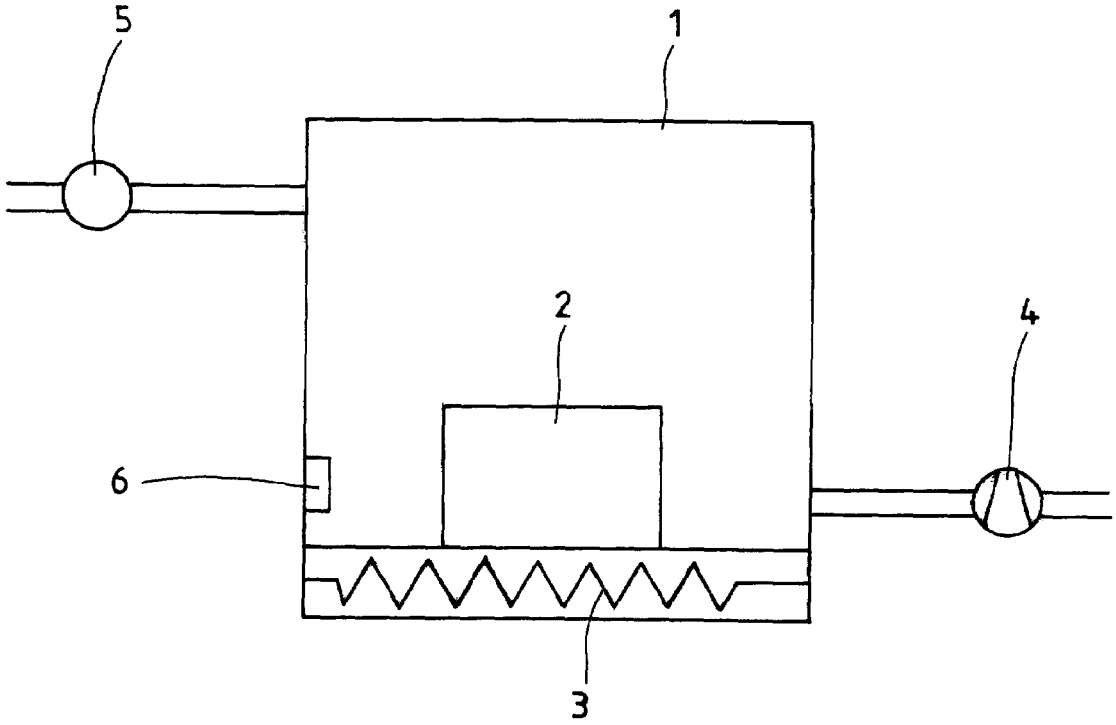

A component 2 is situated in a furnace chamber 1 of a vacuum furnace whose surface is to be blacked. The surfaces of the component 2 to be blacked are untreated. Using a heating unit 3, a temperature of 450° C. is generated in the furnace chamber 1. At the same time, the pressure in the furnace chamber 1 is reduced to a pressure of 5 mbar with a vacuum pump 4.

Acetylene ($C_2H_2$) is administered as a carbon-emitting medium to the furnace chamber 1 through a feeding unit 5. The acetylene is decomposed in the furnace chamber 1. Carbon is emitted to the atmosphere in furnace chamber 1. The carbon comes into contact with the surface of component 2 and brings about blacking.

The carbon content in the atmosphere in the furnace space 1 is monitored through a monitoring sensor 6. The monitoring sensor 6 controls the administration of the carbon-emitting medium through a connection (not represented) in order to be able to set an optimal concentration. The carbon content is set such that a sooting of the furnace chamber walls is avoided as far as possible. Toward the end of the processing time, the administration of acetylene is reduced in order to obtain an optimal exploitation of the carbon. After a processing time of two hours, the remaining atmosphere is sucked off and ambient pressure is restored in the furnace chamber. Moreover, the furnace space and the component 2 are immediately cooled off as rapidly as possible so that the device is available for the next process that does not have any consequent changes in properties on the blacked component 2. Subsequently, the component 2 with blacked surface can be removed from the furnace chamber 1. The surface black coloration generated in this way adheres fast, which can be demonstrated using an abrasion test.

The invention claimed is:

1. Method for treating a components made of steel, the method comprising:

arranging the component inside a processing space, wherein the surface of the component is untreated;

subjecting athe untreated surface to a heat treatment, wherein supplying simultaneously a carbon-emitting medium into the processing space in order to achieve a blacked surface of the component;

performing the heat treatment at a low pressure, wherein a low pressure from 0.01 mbar to 15 mbar is applied; and regulating a carbon content inside the processing space as a function of pressure, wherein the pressure is varied in order to reach a change of atmosphere in the processing space through the duration of the treatment.

2. Method according to claim 1, wherein the heat treatment is conducted at a temperature from 200° C. to 700° C.

3. Method according to claim 2, wherein the heat treatment is conducted at a temperature from 300° C. to 570° C.

4. Method according to claim 2, wherein the heat treatment takes place at a temperature from 350° C. to 475° C.

5. Method according to claim 1, wherein a regulation of a processing time takes place as a function of temperature and/or pressure.

6. Method according to claim 1, wherein a carbon content is regulated inside the processing space as a function of temperature.

7. Method according to claim 1, wherein the carbon-emitting medium is administered in the form of a gas.

8. Method according to claim 1, wherein the carbon-emitting medium is administered in the form of a liquid.

9. Method according to claim 1, wherein hydrocarbons are administered as the carbon-emitting medium.

* * * * *